United States Patent [19]

Bach et al.

[11] Patent Number: 4,927,377

[45] Date of Patent: May 22, 1990

[54] PROTECTOR FOR JOINED EXTENSION CORDS

[76] Inventors: William D. Bach, 5715 Ventura Canyon Ave., Van Nuys, Calif. 91401; Donald R. Murphy, 3861 Poppyseed La., Apt. #1, Calabasas, Calif. 91302

[21] Appl. No.: 282,624

[22] Filed: Dec. 12, 1988

[51] Int. Cl.[5] ..... H01R 13/62

[52] U.S. Cl. ..... 439/367; 439/371

[58] Field of Search ..... 439/366, 367, 368, 369, 439/370, 371, 373

[56] References Cited

U.S. PATENT DOCUMENTS 3,030,601 4/1962 Krebs ..... 439/369

4,643,505 2/1987 House et al. ..... 439/369

*Primary Examiner*—Neil Abrams

*Assistant Examiner*—Khiem Nguyen

*Attorney, Agent, or Firm*—Frank L. Zugelter

[57] ABSTRACT

A protector for electrical extension cords which are connected together by their conventional male and female members, the protector preventing unintentional disjoinder. A pair of podlike shells mate along first and second longitudinal edges, hinged on the first, with closure means mounted on the second longitudinal edge. Two pairs of prongs are integrally formed on and extend from the interior wall of one of the shells, each pair located proximate a corresponding one of distal ends of the protector. A hook is formed on each of the prongs. A pair of stretchable bands engage corresponding hooks in each pair of prongs and the cords ' plugs are introduced through them, and are joined together. They are rotated 180° and the shells are closed upon one another, so that the bands twisted and entwined about the plugs urge them together. An aperture is formed in each of the distal ends of the closed protector to accomodate disposition of the cords.

11 Claims, 1 Drawing Sheet

PROTECTOR FOR JOINED EXTENSION CORDS

TECHNICAL FIELD

This invention relates to a device for protecting and maintaining joined male and female plugs of connected cords, and is particularly related to electrical cords, to prevent accidental disconnection of them and particularly to a protector and an assembly therein to maintain connection of electrical extension cords.

DESCRIPTION OF THE PRIOR ART

Prior art devices of the type of subject matter like the present invention are disclosed in the following U.S. Pat. Nos. 2,720,633; 3,014,194; 3,048,810; 3,718,761; 4,206,961; 4,603,933; and 4,643,505.

SUMMARY OF THE INVENTION

The invention is directed to a protecting device by which cords, usually electrical ones with corresponding male and female plugs, are maintained in a connected relationship regardless of pulls and knocks to which the connected cords are subjected by various and kinds of forces that may be applied to the cords or at their junction at which the male and female plugs are joined.

It comprises a protector formed by two podlike shells defining a cavity in their closed mode, and being hinged to one another for an open as well as closed mode, closure means for maintaining the shells in closed mode, semi-circular ports located at the distal ends of each of the shells and through which the lengths of two cords to be connected together extend to stretchable bands which maintain the plugs in joined relationship, and means for attaching the bands to the protector integrally formed upon and generally upstanding from the interior surface of one of the shells. The bands maintain the joined relationship of the plugs after they have engaged the attaching means and have been applied to the plugs. The attaching means takes the form of hooks mounted on corresponding prongs, more particularly, two pairs thereof. Each pair of prongs is spaced one from the other, such spacing traversing a longitudinal direction for the protector. In turn, each hook and its prong in each of such pairs is spaced from the other in a lateral manner, across a general longitudinal axis for the protector, while each such hook in its pair also faces a semi-circular port in the shell's end nearest them. One stretchable band engages the hooks of one pair of attaching means, while the other band likewise engages the hooks of the other pair of attaching means. With reference to electrical extension cords, one having a female plug and the other having a male plug, each one of these cords is thrust through one of the bands and then their male and female plugs joined together, disposed within the central portion of the protector's cavity, while the bands engage their corresponding attaching means. The connected cords and the bands then are turned 180° relative to the longitudinal direction of the protector. In so doing, the bands are thereby twisted and entwined about these plugs and urge them to remain joined. The lengths of the cords are positioned in their associated semi-circular ports at the opposing distal ends of the one shell, and the second shell then is closed upon the first, the semi-circular ports at each distal end of the protector closing upon one another to form an aperture about the cord extending therethrough. The joined plugs are not pulled apart from one another while in such closed mode of the protector, by the fact of the twisted and entwined stretched bands about them, urging them to stay together. Thus any accidental dislodgement of the protector from its particular position in a work area may bandy the protector about, but it will not disengage the joined-together plugs. And in a deliberately-made movement in the work area for the connected cords, the plugs do not come apart.

An object of the invention is to keep joined together a male and a female plug on extension cords, particularly electrical, during use of extension cords in a work area.

Another object of the invention is to prevent an uncoupling of such plugs, particularly where they are part and parcel of an electrical line used in the work area.

A further object of the invention is to eliminate labor and time, and thus monetary costs, that personnel are required to take to rejoin disconnected male and female plugs, particularly in an electrical line application, in extension cords.

Still another object of the invention is to provide a streamlined profile for the protector so that in the event it is deliberately displaced from one point to another, or blocked from freely moving at its place in its movement (as the line may be required to be pulled to-and-fro in the work area), the plugs do not come apart one from another.

Another object of the invention is to eliminate time, work, personnel and monetary costs that otherwise would arise in the event joined plugs were to come apart and would have to be joined together again in order to continue work.

These and other objects and advantages of the invention will become more apparent upon a full and complete reading of the following description, the appended claims thereto, and the drawing of an embodiment illustrating the inventive concept as shown in the accompanying one (1) sheet of drawing.

DESCRIPTION OF THE ACCOMPANYING DRAWING

DESCRIPTION OF THE PREFERRED EMBODIMENT

Figures 1, 2, 3, 4, 5, 6:
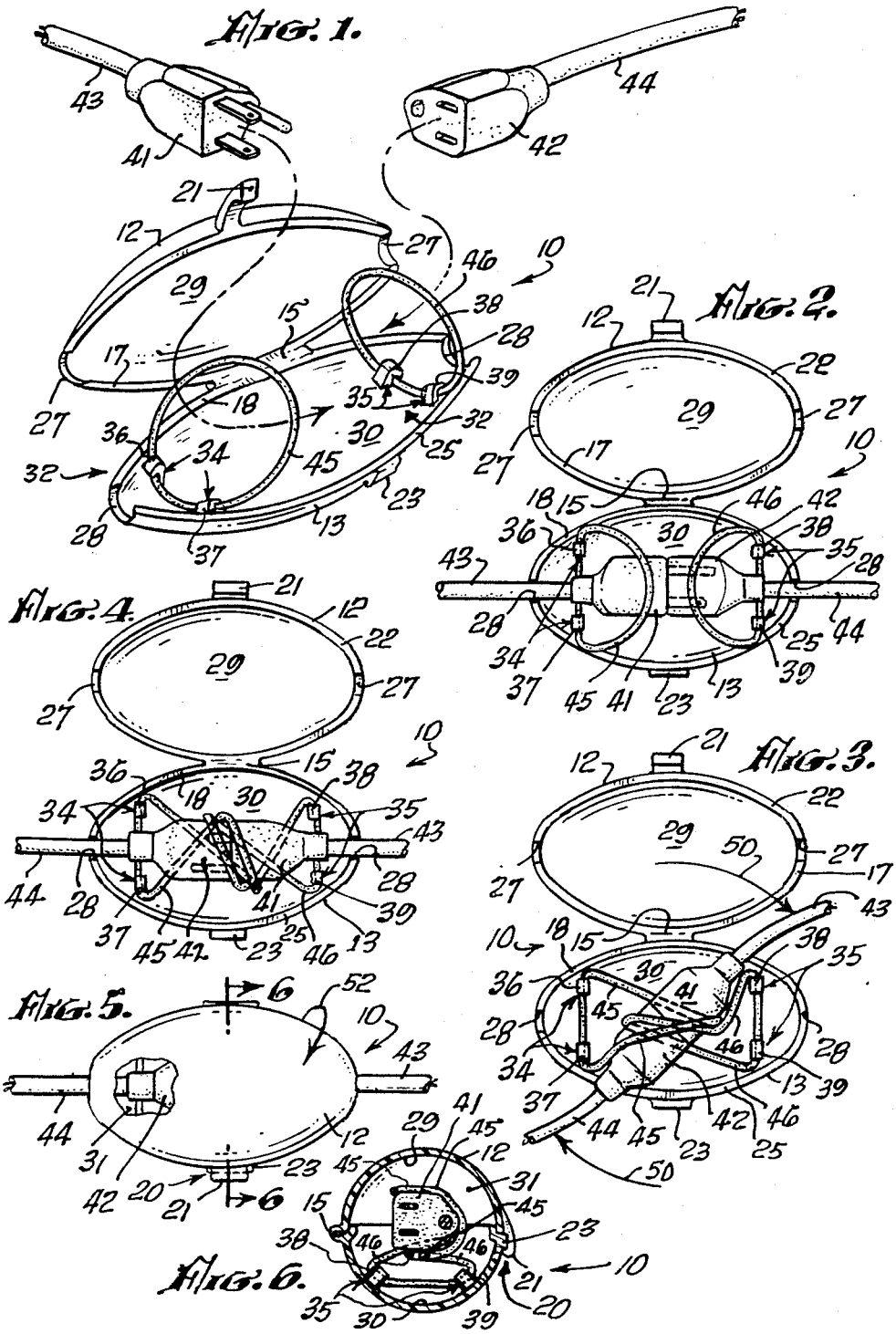
FIG. 1 is a perspective view of an open-mode protector with stretchable bands in place and separated male and female plugs ready for application to the invention.
FIG. 2 is a plan view of an open-mode protector with the plugs joined together within its cavity and stretchable bands in place about the cords and their plugs.
FIG. 3 is a view similar to vieW FIG. 2, however, showing the joined plugs in a rotated position, with bands twisted and entwined in such position, from their position shown in FIG. 2.
FIG. 4 is a view similar to FIG. 3, but with the joined plugs in a completed rotated position, with bands twisted about the plugs and entwined about themselves, and as seated within a shell.
FIG. 5 is a view of a protector in closed mode, partly broken away, with the plugs, extension cords, and stretched bands of FIG. 4 within such protector.
FIG. 6 is a view taken on line 6—6 of FIG. 5.

Referring now to the accompanying drawing wherein reference characters correspond to like numerals hereinafter, FIG. 1 illustrates the invention in its open-mode position preparatory to its operation. The invention is illustrated in the form of protector 10 comprising a pair of podlike-configured shells 12, 13 integrally hinged together as at 15 midway their lengths and along cooperating longitudinal edges 17, 18 for shells 12, 13 respectively, closure means 20, FIGS. 5, 6, comprising a latch 21, FIGS. 1–4, mounted midway of another longitudinal edge 22 on shell 12 and a catch 23 for latch 21 mounted in corresponding manner midway of longitudinal edge 25 on shell 13, and semi-circular ports 27, 28 formed on corresponding distal ends for shells 12, 13, respectively. Upon the closing of shells 12, 13, edge 17 mates to edge 18 and edge 22 mates to edge 25, and ports 27, 28 mate to or close up on one another to provide a full or circular aperture in each of such distal ends. Shells 12, 13 are configured in a scalloped-like manner so as to produce respective walls having interior surfaces 29, 30 which form a (closed) cavity 31, FIGS. 5, 6, when protector 10 is in its closed mode.

Mounted on interior surface 30 of shell 13 are attaching means 32, FIG. 1, comprising two pairs of generally upstanding prongs 34 and 35, respectively, on the ends of which hooks 36, 37 and 38 are formed, preferably integrally with their corresponding prongs. The hooks 36, 37 and 38 in their respective pairs of prongs 34, 35 face the distal end of protector 10 closest to them, vis-a-vis facing the central portion of cavity 31, however, their facing direction is not limited merely to directly facing their corresponding apertures formed by ports 27, 28 at both distal ends of protector 10, nor are such hooks to face the disposition or location for the plugs in cavity 31 as the device obviously would not efficiently operate.

The pairs of prongs 34, 35 are spaced one from another in the longitudinal direction for protector 10, as clearly illustrated in FIGS. 1–4, so that sufficient volume in the central portion of (closed) cavity 31 is provided for the disposition or location of male and female plugs 41, 42, respectively, incorporated within their respective cords 43, 44, in the operation of the invention. Also, the hooks 36, 37 in pair 34 and the hooks 38, 39 in pair 35 are correspondingly spaced laterally upon interior surface 30 of shell 13, one from the other as clearly shown in FIGS. 1–4, preferably disposed equally from a plane passing centrally through shell 13 and longitudinally along its length.

A pair of endless stretchable bands 45, 46 are provided as part of and in assembly of the invention. Each band 45, 46 correspondingly attaches to or engages the two hooks in each pair of prongs, as shown in the FIGURES. It is this pair of bands which twist and entwine upon male and female plugs 41, 42, FIG. 1, respectively, and themselves, in the operation of the invention. Plugs 41, 42 are incorporated in known manner within their corresponding cords 43, 44 in the art of extension cords.

In operation of the invention, with shells 12, 13 of protector 10 in open mode as shown in FIGS. 1–4, each band 45, 46 first is placed into engagement with its corresponding hooks 36, 37 and 38, 39 in each pair of prongs 34, 35, respectively. Male plug 41 is thrust through band 45, while female plug 42 is thrust through band 46, each of such thrusts in a direction longitudinally and from exteriorly of protector 10 toward the central portion of its (open) cavity 31. Thereafter, plugs 41, 42 can be manually joined together, such joined status being illustrated in FIG. 2. Alternatively, band 45 is introduced upon cord 43 over plug 41 while band 46 is introduced upon cord 44 over plug 42, the plugs not being joined while doing this, and thereafter, the plugs then joined while cords 43, 44 are introduced into semi-conductor ports 28 of shell 13. Bands 45, 46 then are mounted to their corresponding pair of hooks in each pair of prongs 34, 35.

The joined plugs 41, 42 along with their cords 43, 44 then are manually rotated in the direction shown by arrows 50, FIG. 3, so that female plug 42 begins to assume, in FIG. 3, the position of male plug 41 in FIG. 2 and male plug 41 begins to assume the position of female plug 42 in FIG. 2. The final point of rotation of such plugs and their cords is illustrated in FIG. 4, with cords 43, 44 deposited within their corresponding semi-circular ports 28 in shell 13. The bands are so twisted about themselves and entwined about the male and female plugs such that they urge such plugs toward one another constantly. Shell 12 now is folded or closed upon shell 13, in the direction of arrow 52, FIG. 5, with edge 22 cooperatively engaging edge 25 and edge 17 cooperatively engaging edge 18, so that closure means 20 effects the closed mode for protector 10 by latch 21 snapping closed upon its catch 23. FIGS. 5 and 6 illustrate such a closed mode in use of the invention.

In assembly of the invention, bands 45, 46 are introduced to their corresponding pairs of hooks 36, 37 and 38, 39 in each of the prong pairs 34, 35 of the attaching means, in the manner shown FIG. 1, while in so doing the one shell 12 is in open relationship to the other shell 13. Shells 12, 13 then are manually closed to assume their relative positions shown by FIGS. 5 and 6, with latch 21 and catch 23 engaging one another.

Shells 12, 13 together with hinge 15 preferably is a one-piece member, of suitable rubber or plastic, although other suitable materials may be utilized. The stretchable bands 45, 46 are preferably made to include fibrous material, for long life, such as Bungecord or Fibertex elastic cable made by Bungee International Manufacturing Corporation, 20740 Plummer Street Chatsworth, Calif., or of other elastic cable material, suitable to utilization in the invention. Ordinary rubber bands of sufficient strength may likewise be used or substituted for bands 45, 46. All of the other aforesaid described elements are fabricated by known processes and known techniques in the art.

It should be understood that the relationship of the bands to the plugs illustrated in FIGS. 3, 4 and 6 is not limited thereto, as in each instance of rotating the joined plugs, the bands do not hug and urge the plugs together in the exact positioning one upon the other, as perhaps these FIGS. 3, 4 and 6 would suggest. The bands entwine about the plugs, nevertheless, regardless of not being positioned exactly as shown in such FIGS., to urge them to remain joined together.

Various changes and modifications may be made which are within and without altering the scope, the spirit or the letter of the invention. For example, the prongs need not be limited to merely two pairs as illustrated in the FIGURES. The closed protector's silhouette may take the shape of a bullet as well as that of a football which appears in the illustrating FIGURES, as well as other forms or body configurations for the shells as desired by the user. Other forms of hinges may be used than one integrally formed to shells 12, 13, to cause edges 22, 25 and 17, 18 to mate. Also, attaching means 32 may be mounted on an interior surface 29 which a latch 21 mounted on shell 12 is provided, vis-a-vis being mounted as illustrated in FIG. 1, on an interior wall on which catch 23 is mounted. Further, the height of the attaching means, or any one of them, measured between the interior surface of the wall on which it or any one of them is mounted and a plane passing through the top of the hooks, need not be limited to the portion of one-half of cavity 31 within only one of the shells. Such height may extend into the confines of the opposing shell as well.

We claim:

1. In a protector for joined plugs on the ends of cords, said protector comprising a pair of shells each of which having a wall and interior surface thereon and closable upon one another to form a cavity while providing distal ports which produce apertures in its closed mode, the joined plugs adapted to be disposed within such cavity in the protector's open mode, the improvement comprising means for attaching to the protector stretchable bands adapted to be twisted and entwined about such plugs to keep them joined together, said attaching means being mounted to the interior surface of the wall of one of the shells.

2. The improvement of claim 1, wherein said attaching means comprises a plurality of prongs integrally formed on and extending from said interior surface, and at least two pairs of said plurality of prongs being spaced from one another in longitudinal direction for said protector, each of said prongs in each of said pairs being spaced laterally one from the other, the cords adapted for disposition through said apertures, their plugs being adapted to be disposed along such longitudinal direction in such cavity between the prongs in each of said pairs, and hooks on each of said prongs.

3. In the protector of claim 2, the improvement further comprising a pair of stretchable bands, each of said bands engaging the hooks in a corresponding one of said pairs of said plurality of prongs.

4. In the improvement of claim 3, each of said pair of shells having first and second longitudinal edges, said first mating with each other and said second mating with each other in a closure mode for the protector, hinging means for said shells mounted on the first of said longitudinal edges for both shells, and closure means mounted on the second of said longitudinal edges for both shells.

5. In the improvement of claim 2, each of said pair of shells having first and second longitudinal edges, said first mating with each other and said second mating with each other in a closure mode for the protector, hinging means for said shells mounted on the first of said longitudinal edges for both shells, and closure means mounted on the second of said longitudinal edges for both shells.

6. A protector for joined male and female plugs adapted to the ends of electrical cords, said protector comprising a pair of shells each having an interior wall and a first longitudinal edge and a second longitudinal edge, said first mating with each other and the second mating with each other, in a closure mode for the protector to produce a cavity therein while providing distal apertures in and through which said cords extend so that their plugs are capable of being joined together and disposed within such cavity, and means for attaching to said protector stretchable bands adapted to be twisted and entwined about such plugs to keep them joined together, said attaching means being mounted to the interior wall on one of said shells.

7. The protector of claim 6 wherein said attaching means comprises at least two pairs of prongs each pair of which being integrally formed on and extending from said interior surface of one of said shells, said pairs spaced from one another in a longitudinal direction for said protector, the prongs in each of said pairs spaced laterally one from the other, and hooks on each of said prongs.

8. The protector of claim 7 including a pair of stretchable bands each one of which cooperatively engaging the hooks in a corresponding one of said two pairs of prongs.

9. The protector of claim 8 including hinging means for said shells mounted on the first of said longitudinal edges for both shells, and closure means mounted on the second of said longitudinal edges for both shells.

10. The protector of claim 7 including hinging means for said shells mounted on the first of said longitudinal edges for both shells, and closure means mounted on the second of said longitudinal edges for both shells.

11. The protector of claim 6 including hinging means for said shells mounted on the first of said longitudinal edges for both shells, and closure means mounted on the second of said longitudinal edges for both shells.

* * * * *

UNITED STATES PATENT AND TRADEMARK OFFICE

CERTIFICATE OF CORRECTION

PATENT NO. : 4,927,377

DATED : May 22, 1990

INVENTOR(S) : William D. Bach
Donald R. Murphy

It is certified that error appears in the above-identified patent and that said Letters Patent is hereby corrected as shown below:

The indefinite article --a-- is to be read after "in" in line 25 of column 5.

Signed and Sealed this

Ninth Day of July, 1991

*Attest:*

HARRY F. MANBECK, JR.

*Attesting Officer*

*Commissioner of Patents and Trademarks*